US006029290A

United States Patent [19]

Butcher et al.

[11] Patent Number: 6,029,290

[45] Date of Patent: Feb. 29, 2000

[54] SWIMMING POOL SKIMMER CLEANER

[75] Inventors: Greg Butcher; Randy Smith, both of Houston, Tex.

[73] Assignee: Skimmer Valet, Inc., Houston, Tex.

[21] Appl. No.: 09/178,807

[22] Filed: Oct. 26, 1998

[51] Int. Cl.[7] ..... E04H 4/00

[52] U.S. Cl. ..... 4/490; 4/507; 4/510; 4/512; 210/169; 210/776

[58] Field of Search ..... 4/490, 507, 508, 4/509, 510, 511, 512, 496; 210/169, 776, 400, 783; 198/493, 494, 716, 717; 209/307, 622–624, 685, 926

[56] References Cited

U.S. PATENT DOCUMENTS 3,637,080 1/1972 Markel ..... 210/776

4,261,827 4/1981 Bronnec ..... 210/400

FOREIGN PATENT DOCUMENTS 2547474 5/1977 Germany ..... 209/926

*Primary Examiner*—Henry J. Recla
*Assistant Examiner*—Tuan Nguyen
*Attorney, Agent, or Firm*—Robert C. Shaddox; Henry L. Ehrlich; Winstead Sechrest & Minick P.C.

[57] ABSTRACT

An invention utilizing a conveyor belt to remove debris from a swimming pool filtration system skimmer and deposit it into a waste receptacle. The lower end of the conveyor belt is inserted into the skimmer below the level of the water. As the conveyor belt is rotated, it removes debris from the skimmer to a point outside the skimmer where the conveyor belt deposits it into a receptacle.

17 Claims, 8 Drawing Sheets

SWIMMING POOL SKIMMER CLEANER

BACKGROUND OF THE INVENTION

Swimming pools have long been filtered. The filter system on a swimming pool consists of one or more inlets, a pump, and one or more outlets. As the pools are open to the environment, they are subject to contamination by a variety of items of a variety of sizes. In order to trap the larger items which may fall into the pool, including leaves, larger bugs, etc., the inlets to the pump are equipped with a device called a skimmer.

A swimming pool skimmer is essentially a cavity containing a basket. Water enters the skimmer from the pool at the side of the cavity, above the basket. Water exits the skimmer at the bottom of the cavity, below the basket. Debris from the pool follows the water into the skimmer and is trapped in the basket.

DESCRIPTION OF THE PRIOR ART

Conventionally, the skimmer baskets require frequent cleaning. The basket must be physically removed from the skimmer by lifting it from the skimmer. The debris must be disposed of and the basket replaced. Failure to clean the skimmer can lead to a blockage in the filtration system that puts undue burden on the pump. Such cleaning represents an inconvenience not only for the frequency with which it must be done, but because of the location of the skimmer, which is at water level. A pool owner must stoop to get the basket.

Several inventions have been developed to assist in the cleaning of skimmer baskets. Most commonly, people have addressed the skimmer problem by developing hooked sticks suitable for removing the cover from the skimmer and retrieving the basket. Using these inventions, a pool owner may perform these maintenance tasks from a standing position. While such inventions make the task of cleaning the skimmer basket more simple, there remains a need to automate the process. No invention to date relieves the pool owner of the responsibility of constantly giving attention to the skimmer basket.

SUMMARY

The present invention solves the problems associated with cleaning the skimmer basket on swimming pools by providing an automated and automatic process whereby the skimmer is continually cleaned. The invention utilizes a conveyor belt to remove debris from the skimmer and deposit it into a waste receptacle. Accordingly, the skimmer is maintained in a clean state, requiring much less attention. Also as a result, filtration pump life on the pool is enhanced due to decreased instances of clogging. Finally, debris is removed from the pool in a timely manner, providing a cleaner pool environment.

The invention is comprised of an apparatus for use with a filtration system of a swimming pool comprising one or more belts positioned within a skimmer, specifically within the upper portion thereof, beneath the water level and extending therefrom to a point outside of the skimmer; and a driving mechanism mechanically connected to the belt and capable of moving the belt in a rotational direction from the water to the outside of the skimmer and back to the water. The invention may include a top axis and a bottom axis, about which the one or more belts are disposed, said top axis positioned at a point outside of the skimmer, and the bottom axis positioned within the upper skimmer, beneath the water level. The invention may also include an apparatus wherein the one or more belts are composed of a flexible material through which water may flow. The invention may include an apparatus wherein the one or more belts further comprise one or more fins or scoops attachable to the exterior surface of said one or more belts. The one or more fins or scoops may be attachable to said one or more belts such that said one or more fins remain perpendicular to the exterior of said one or more belts. The apparatus may be attachable to said filtration system. The apparatus may be adjoinable to said filtration system. The apparatus may be adjoinable to said filtration system by placement within the skimmer of the filtration system. The apparatus may include a receptacle positionable below the top axis, said receptacle having a top end which is capable of accepting falling material from said belt. The apparatus may include a driving mechanism comprising an electric motor, an internal combustion engine, or a turbine driven by water passing through the apparatus.

Further, the invention is a method for maintaining a skimmer of a swimming pool filtration system comprising the steps of disposing one or more belts within a filtration system so as to be partially submerged in the water of a swimming pool; and rotating the one or more belts in such a manner as to lift one or more articles of debris from the water and deposit it outside the filtration system and outside the swimming pool. The invention may include the step of collecting said one or more articles of debris in a receptacle. The invention may comprise the following additional steps: positioning the one or more belts between a top axis and a bottom axis, the top axis being disposed outside the filtration system and outside the swimming pool, the bottom axis being disposed underneath the water.

The invention is also an apparatus for use with a filtration system of a swimming pool comprising one or more screws positioned within an enclosure, said enclosure within a skimmer beneath the water level and extending therefrom to a point outside of the skimmer; and a driving mechanism mechanically connected to the screw and capable of moving the screw in a rotational direction so as to lift debris from the water to the outside of the skimmer. The apparatus may include one or more screws composed of a material through which water may not flow. The apparatus may be attachable to said filtration system. The apparatus may be adjoinable to said filtration system. The apparatus may be adjoinable to said filtration system by placement within the skimmer of the filtration system. The invention may further comprise a receptacle positionable below said top axis, said receptacle having a top end which is capable of accepting falling material from said screw into said receptacle. The driving mechanism may comprise an electric motor, an internal combustion engine, or a turbine driven by water passing through the apparatus.

DETAILED DESCRIPTION OF THE PREFERRED EMBODIMENT

Figure 1:
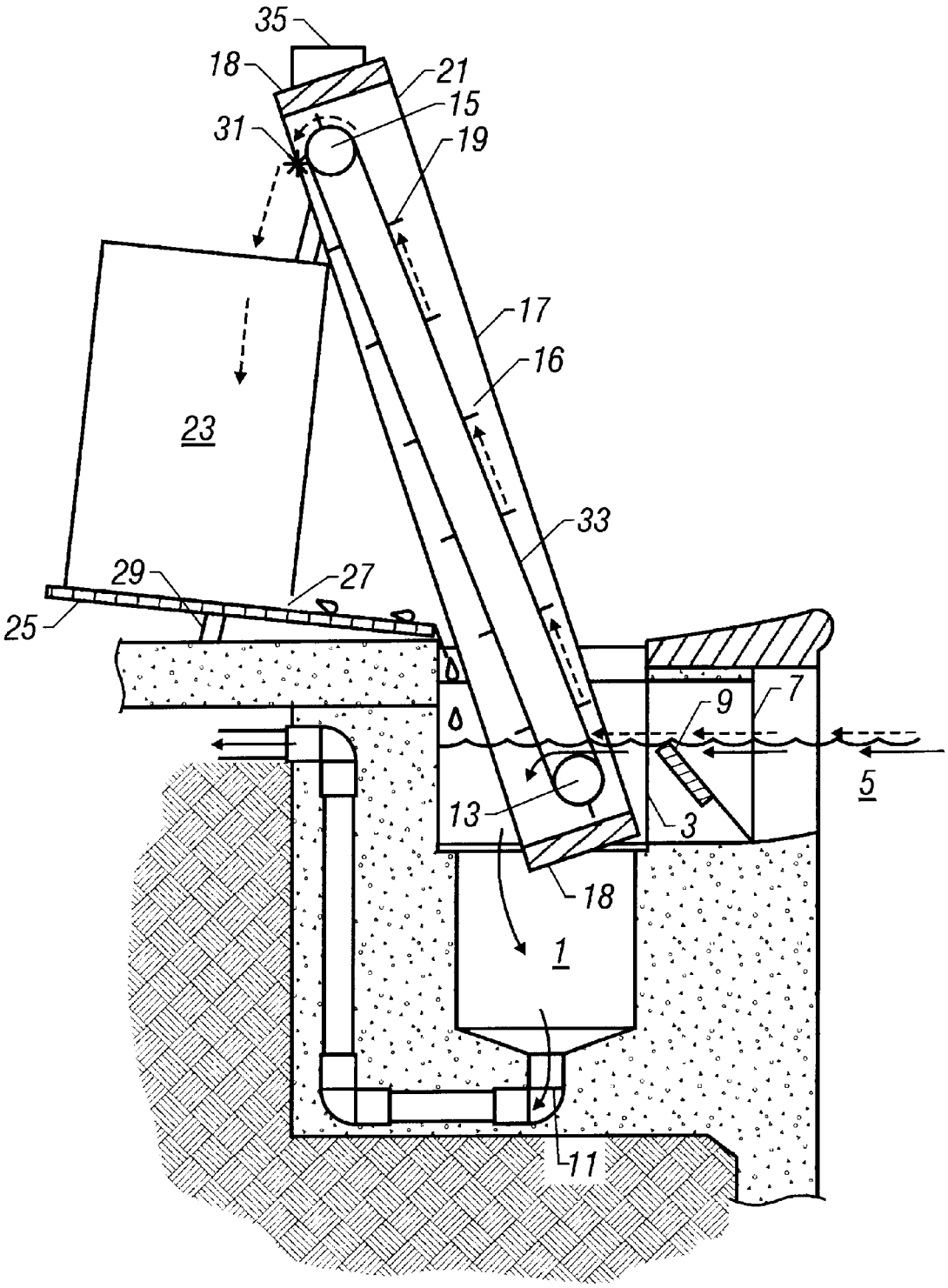
FIG. 1 is a cross-sectional view of the belt, top-driven embodiment of the present invention, as viewed from the side.
Figure 2:
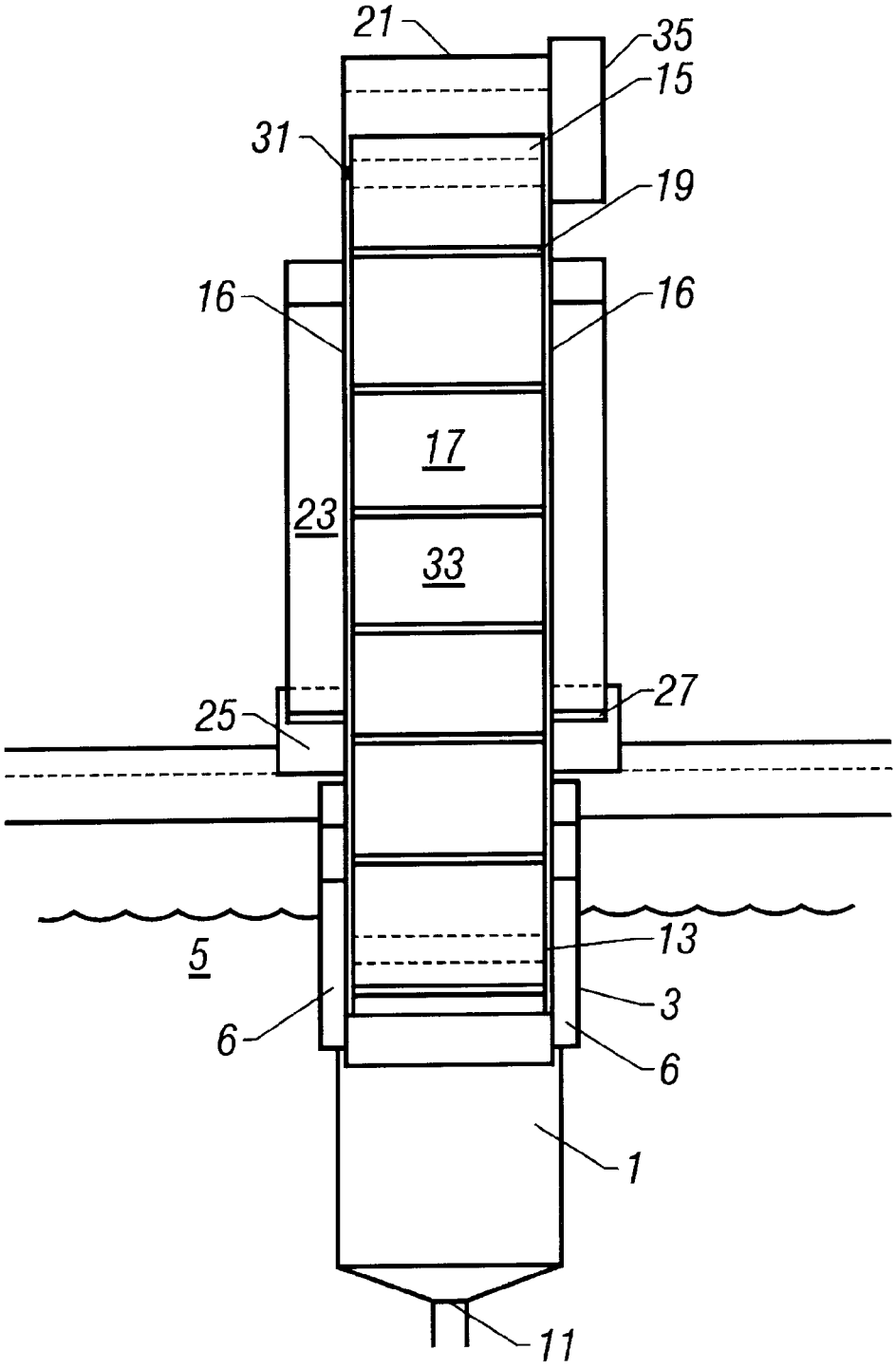
FIG. 2 is a cross-sectional view of the belt, top-driven embodiment of the present invention as viewed from the front.

Referring to FIGS. 1 and 2, a swimming pool skimmer 1, having an upper skimmer 3, is located at the edge of a swimming pool. The upper skimmer 3 is located vertically at such a height as to intercept the level of water 5 within the pool. The water 5 may enter an opening 7 in the upper skimmer 3, passing over a flow control door 9. Once in the upper skimmer 3, the water 5 may flow through the bottom portion of a cleaner 17, which can be situated to rest inside the upper skimmer 3. A flap 6 on either side of the cleaner 17 forces the water 5 to pass through the cleaner 17. The water 5 may then continue through the bottom of the upper skimmer 3 into the skimmer 1. From the skimmer 1, the water 5 may pass via a pipe 11 into a normal filtration system.

The cleaner 17 is composed of an enclosure 21 and a belt 33 which is positioned so as to be rotatable about the top axis 15 and the bottom axis 13. The top axis 15 and the bottom axis 13 are cylindrical in shape and rotatable in such a manner as to permit the belt 33 to travel from the bottom axis 13 to the top axis 15 on the side of the cleaner 17 which is nearest the opening 7 and to travel from the top axis 15 to the bottom axis 13 on the opposite side. The top axis 15 and the bottom axis 13 may be held in place by two sides 16. The composition and size of the sides 16 may vary and are only required to be sturdy in construction as to maintain tension on the belt 33 between the top axis 15 and the bottom axis 13. The sides 16 are separated and held in place by at least two separator pieces 18. The separator pieces 18 may also vary as to size and construction and are only required to be of sturdy construction as to maintain the sides 16 at such a distance as to disallow the top axis 15 and the bottom axis 13 from binding against the sides 16 while maintaining them within the confines of the sides 16. The belt 33 is rotated about the top axis 15 and the bottom axis 13 by a motor 35 which is affixed to the top axis 15.

The motor 35 can be an electric motor powered by normal house current, but need not be. It can be powered by solar electrical power, electric battery, internal combustion engine, or other means which will produce a rotational power to drive the top axis 15.

The belt 33 can be comprised of any of a number of types of materials. The material must be flexible so as to permit the belt 33 to circulate about the top axis 15 and the bottom axis 13. A fabric, plastic, rubber, fiberglass or non-corrosive wire mesh or screen is preferred in order to allow a flow of the water 5 through the belt 33 while retaining debris. A solid material or chain-type belt 33 may be utilized, as long as the construction permits the belt 33 to rotate about the top axis 15 and the bottom axis 13. It is noted, however, that a solid or chain construction will be less efficient at removing debris from the water 5 and may impede the flow of the water 5 through the filter system.

In the preferred embodiment, one or more scoops 20 (visible in FIG. 5 and 6) or fins 19 are attachable to the belt 33 such that each scoop 20 is curved and attaches to the belt 33 as it circulates about the top axis 15 and the bottom axis 13. The scoops 20 need not be included in the invention, but the effectiveness of the invention is enhanced by their presence. The scoops 20 may also be replaced or supplemented by fins 19, which sit perpendicular to the belt 33 but are straight, rather than curved. The scoops 20 are particularly well suited to removing larger debris from the water 5 within the upper skimmer 3. The scoops 20 and fins 19 can be of like construction as the belt 33, or can be of a different construction. In either event, the material of which the scoops 20 or fins 19 are made is preferred to be a fiberglass, rubber, plastic, or noncorrosive wire mesh so as to permit the water 5 to pass through while retaining debris. Like the belt 33, a solid material may be used, with the possible disadvantage that the scoops 20 and fins 19 will not permit water to flow as freely through the invention.

The cleaner 17 can be positioned at an angle to the upper skimmer 3 so that the top portion of the cleaner 17 extends beyond the edge of the upper skimmer 3 in a horizontal direction away from the water 5 and the opening 7. A receptacle 23 may then be positioned below the top end of the cleaner 17. As debris is carried up the belt 33 and on the fins 19 or scoops 20 over the top axis 15, the debris then falls by operation of gravity into the receptacle 23.

In the preferred embodiment, the receptacle 23 is positioned at an angle to the horizontal upon a platform 25. The platform 25 can rest upon the ground and upon a support 29 in order to insure that an angle to the horizontal is maintained. An opening 27 in the bottom of the receptacle 23 on the lower comer of the receptacle serves to allow water 5 carried into the receptacle 23 to drain back into the upper skimmer 3. The opening 27 must be wide enough to permit the water 5 to escape, but must be narrow enough to disallow debris in the receptacle 23 from reentering the upper skimmer 3. While it is preferred that the opening 27 extend the width of the receptacle 23, the opening 27 may be composed of one or more apertures of a configuration to achieve the ends described.

In order to facilitate the removal of debris from the belt 33 at the top of the cleaner 17, a brush 31 can be positioned adjacent to the top axis 15 in such a way that it contacts the belt 33 as it begins its decent from the top axis 15 to the bottom axis 13. The brush 31 is connectable to the motor 35 so as to be driven rotationally opposite to the direction of the belt 33. In this manner, the brush 31 effectively removes any debris stuck to the belt 33 or to the fins 19, permitting said debris to fall into the receptacle 23.

Figure 3:
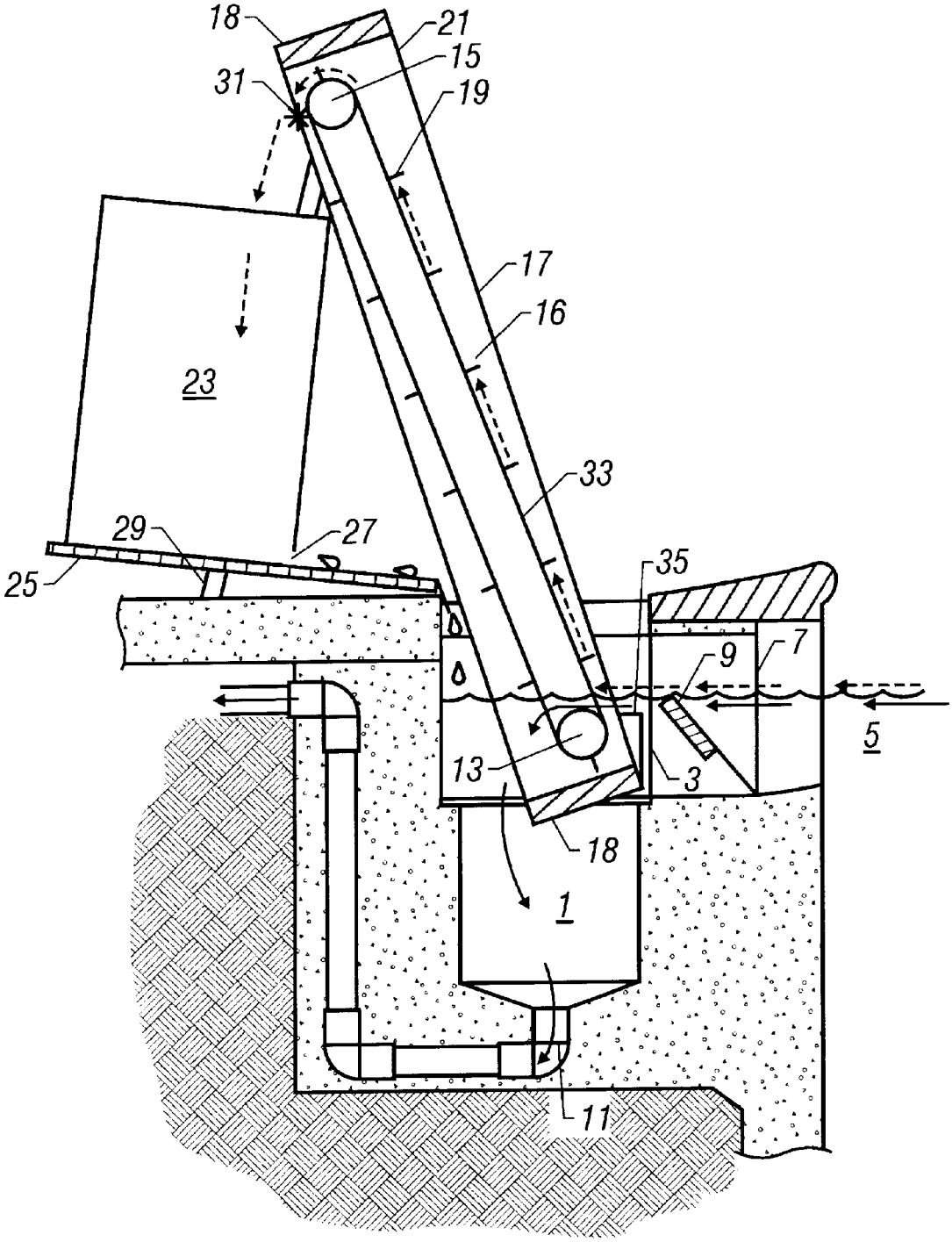
FIG. 3 is a cross-sectional view of the belt, top-driven embodiment of the present invention as viewed from the side.
Figure 4:
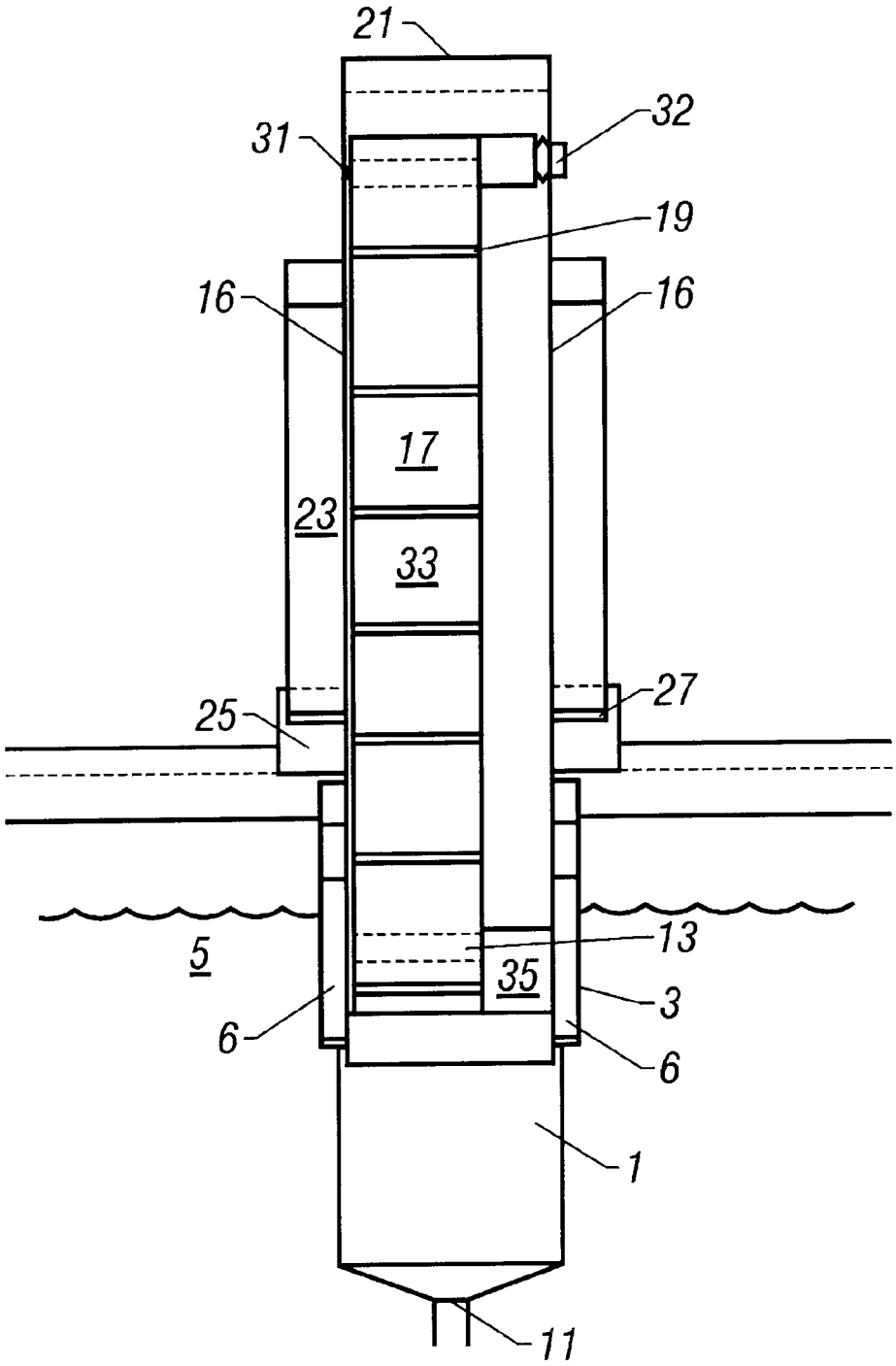
FIG. 4 is a cross-sectional view of the belt, bottom-driven embodiment of the present invention as viewed from the front.

In an alternative embodiment, demonstrated in FIGS. 3 and 4, the motor 35 may be connected to the bottom axis 13. Such a configuration has the advantage of a less top-heavy apparatus, but has the disadvantage of requiring a waterproof motor. Further, the placement of the motor 35 in this embodiment may leave less space within the upper skimmer 3 for the belt 33, requiring a narrower belt. In such case, the brush 31 can be driven by means of a gearbox 32 which connects the top axis 15 to the brush 31.

Figure 5:
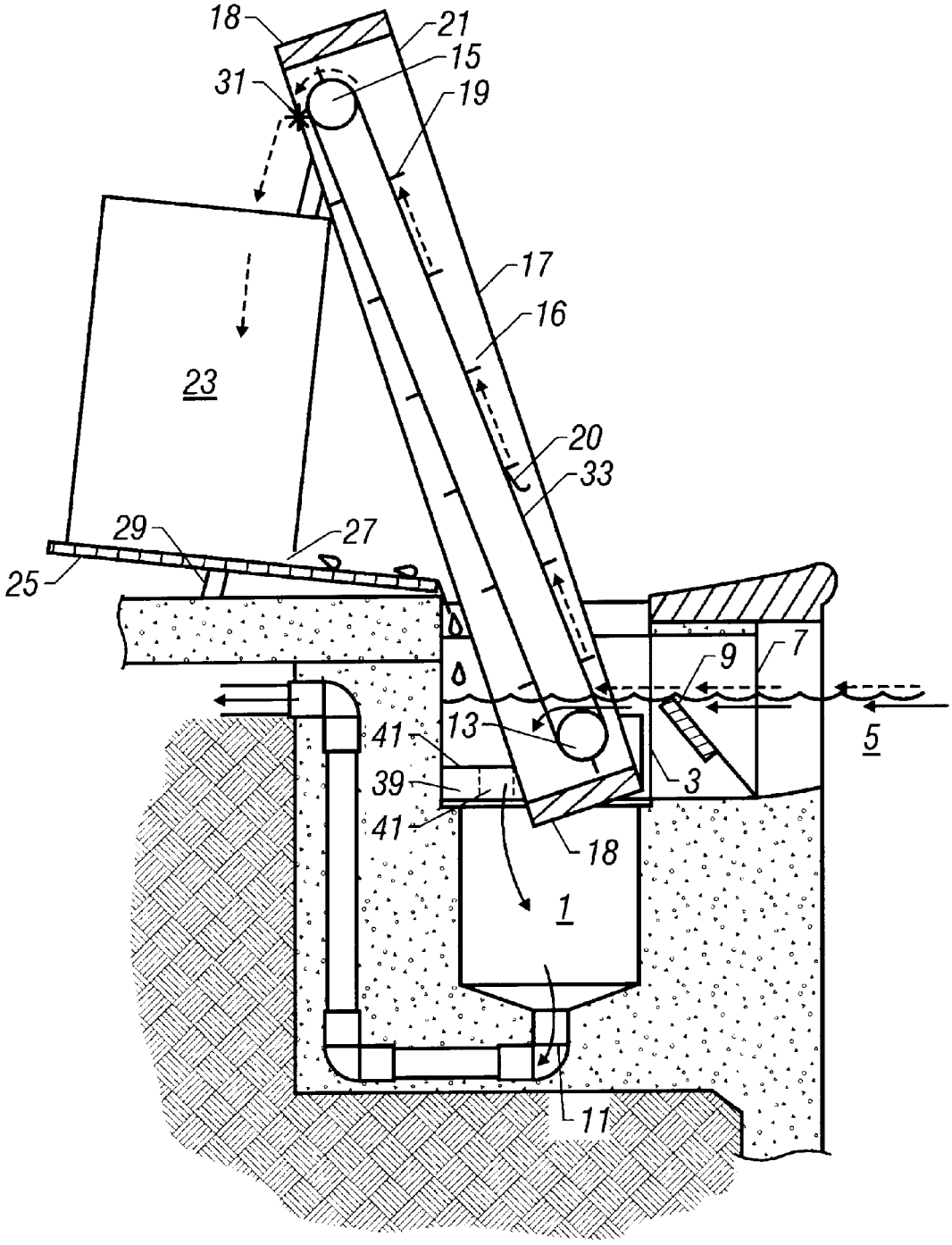
FIG. 5 is a cross-sectional view of the belt, hydraulically-driven embodiment of the present invention as viewed from the side.
Figure 6:
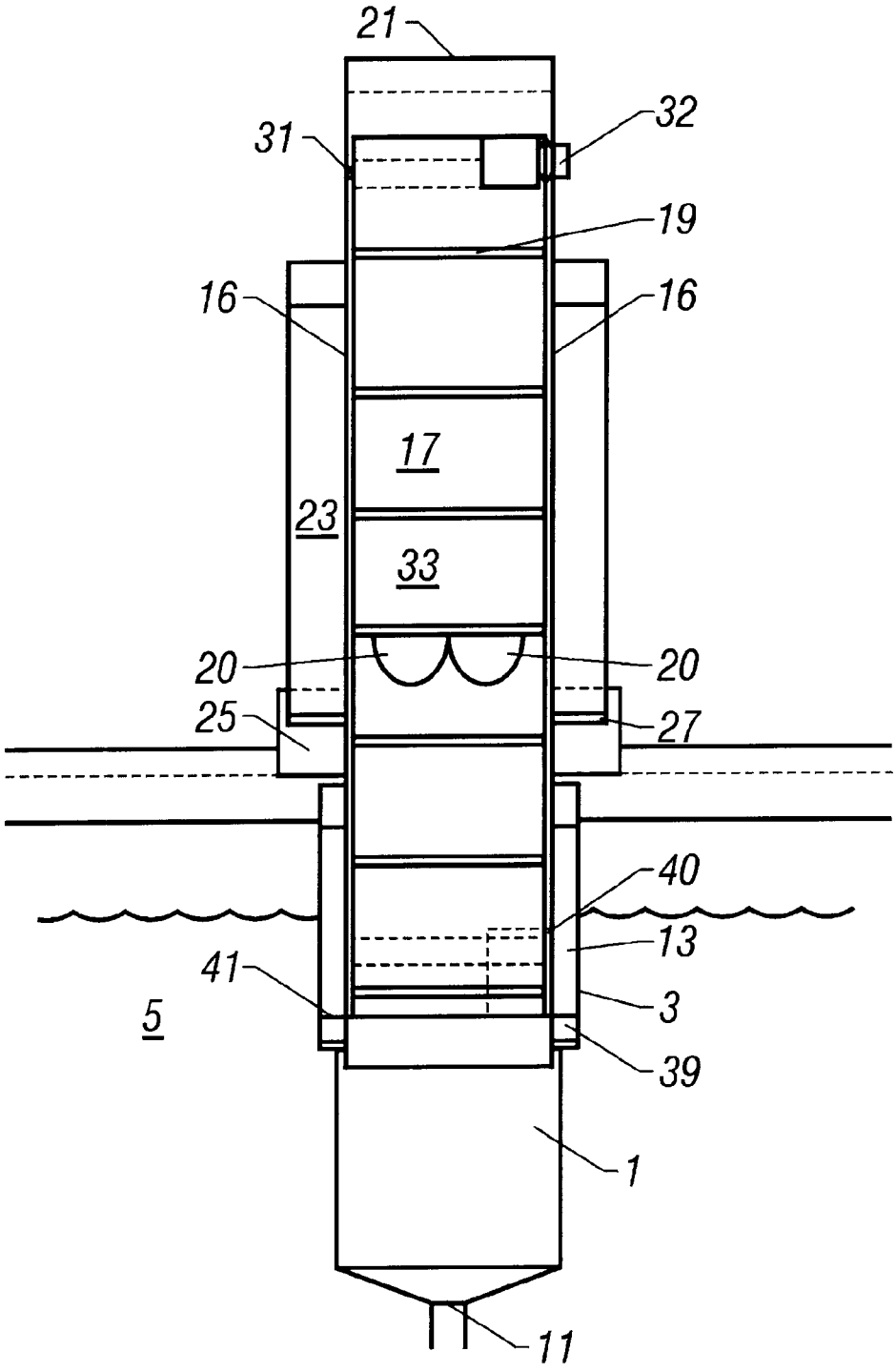
FIG. 6 is a cross-sectional view of the belt, hydraulically-driven embodiment as viewed from the front.

As illustrated in FIGS. 5 and 6, the motor 35 may be omitted and replaced by a turbine 39. The turbine 39 is drivable by the hydraulic action of the water 5 as it flows through the opening 7, through the upper skimmer 3, and through the skimmer 1. A plate 41 precludes the flow of the water 5 except through one or more turbine apertures 43. The turbine 39 in turn drives a gear box 40, which in turn drives the bottom axis 13. This embodiment has the advantages of the operation of the invention without the need for an additional power source of any sort.

Figure 7:
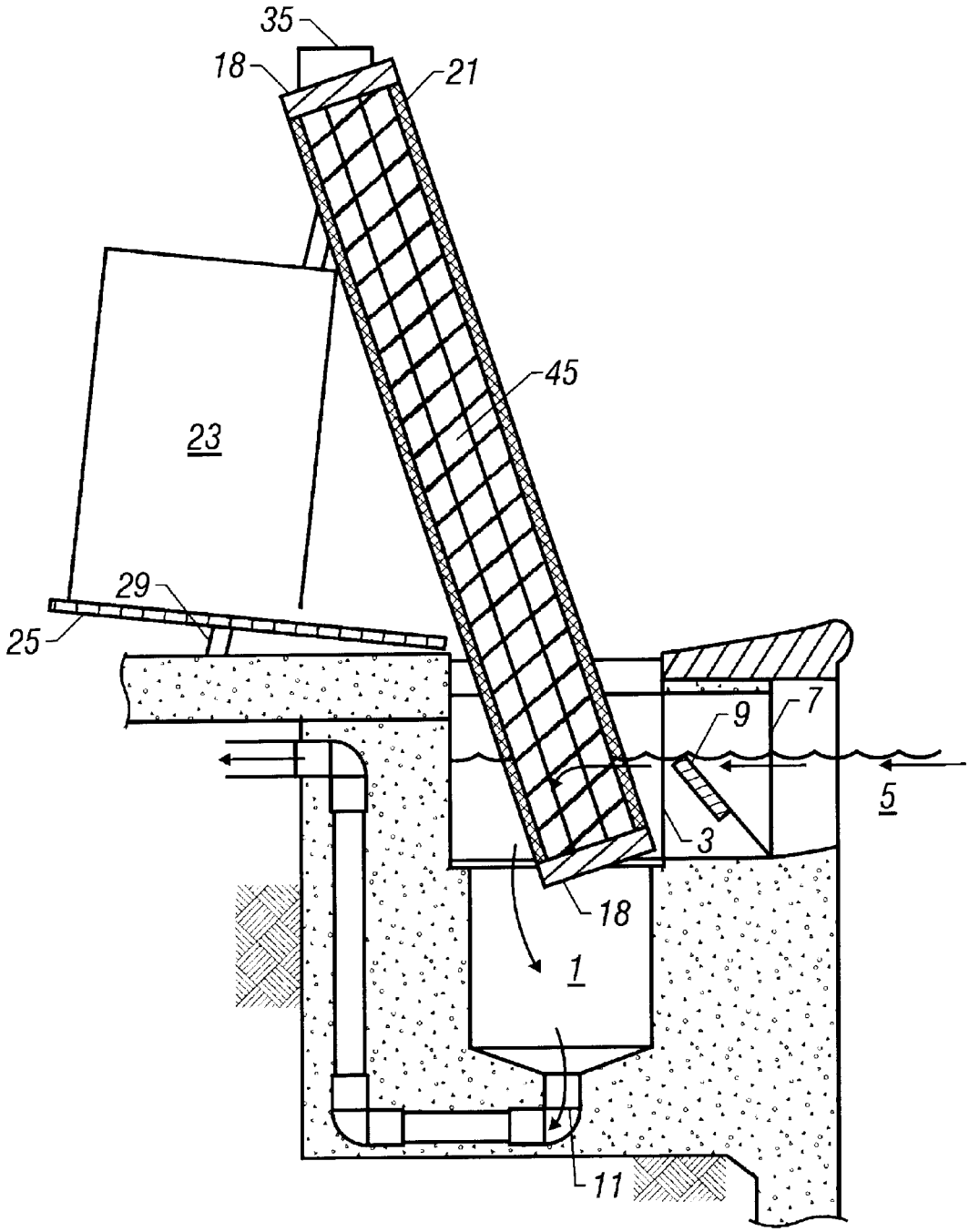
FIG. 7 is a cross-sectional view of the present invention as viewed from the side depicting a screw-based embodiment.
Figure 8:
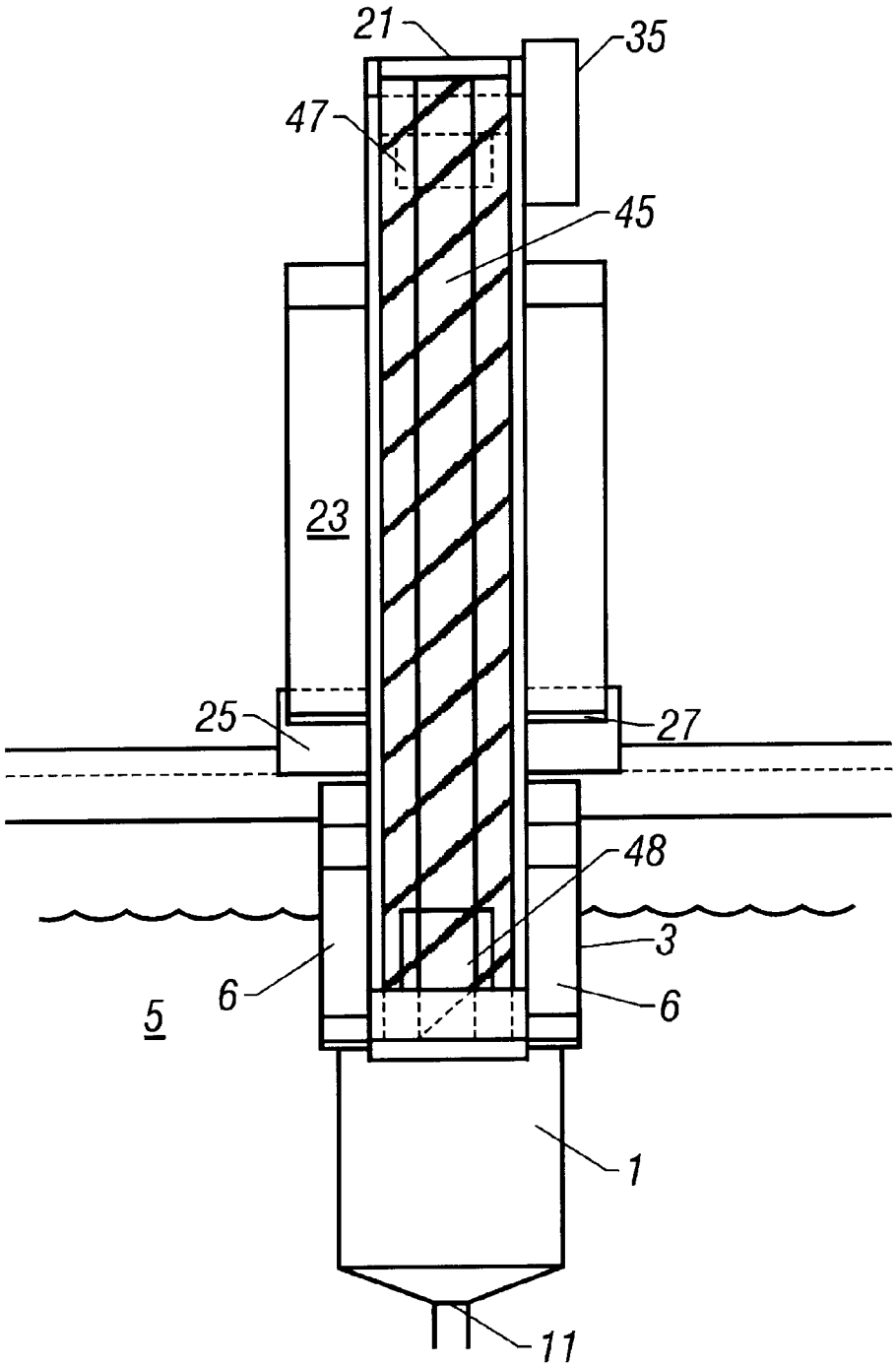
FIG. 8 is a cross-sectional view from the front of the present invention depicting a screw-based embodiment.

FIGS. 7 and 8 demonstrate an alternative embodiment of the invention. In this embodiment, the belt 33 and the fins 19 or scoops 20 are not used. Instead, a screw 45 is placed within the enclosure 21. The screw 45 is driven by the motor 35 such that debris entering the enclosure 21 through a lower portal 48 is passed up the enclosure 21 to an upper portal 47. Debris exiting the upper portal 47 then falls by operation of gravity into the receptacle 23.

By extension, the screw 45 illustrated in FIGS. 7 and 8 may be utilized with the lower motor configuration demonstrated in FIGS. 3 and 4 or with the turbine configuration noted in FIGS. 5 and 6.

As to the manner of operation and use of the present invention, the same is made apparent from the foregoing discussion. With respect to the above description, it is to be realized that although dimensional embodiments of specific material is disclosed, those enabling embodiments are illustrative, and the optimum dimension relationships for the parts of the invention are to include variations in composition, form, function and manner of operation, assembly and use, which are deemed readily apparent to one skilled in the art in view of this disclosure, and all equivalent relationships to those illustrated in the drawings and encompassed in the specifications are intended to be encompassed by the present invention.

Therefore, the foregoing is considered as illustrative of the principles of the invention and since numerous modifications will readily occur to those skilled in the art, it is not desired to limit the invention to the exact construction and operation shown or described, and all suitable modifications and equivalents may be resorted to, falling within the scope of the invention.

What is claimed is:

1. An apparatus for use with a filtration system of a swimming pool having water in it, the apparatus comprising:

at least one belt adapted to be positioned within a skimmer beneath the water level and extending therefrom to a point outside of the skimmer; and a driving mechanism mechanically connected to said belt and capable of moving said belt in a circulating direction between at least two axises, at least one such axis being in the water and the at least one such axis being out of the water.

2. The apparatus described in claim 1 wherein the at least two axises comprise:

a top axis and a bottom axis, about which said at least one belt is disposed, said top axis positioned at a point outside of the skimmer, and said bottom axis positioned within the skimmer beneath the water level.

3. The apparatus described in claim 2 further comprising a receptacle positionable below said top axis, said receptacle having a top end which is capable of accepting falling material from said belt into said receptacle.

4. The apparatus of claim 3 wherein said receptacle further comprises an opening in the bottom half thereof from which water may drain.

5. The apparatus described in claim 1 wherein said at least one belt is composed of a flexible material through which water may flow.

6. The apparatus of claim 5 wherein said one or more belts further comprise at least one scoop attachable to the exterior surface of said at least one belt.

7. The apparatus of claim 5 wherein said at least one belt further comprises at least one fin attachable to the exterior surface of said at least one belt.

8. The apparatus of claim 7 wherein said at least one fin is attachable to said at least one belt such that said at least one fin remains perpendicular to the exterior of said at least one belt.

9. The apparatus described in claim 1 wherein the apparatus is attachable to said filtration system.

10. The apparatus described in claim 1 wherein the apparatus is adjoinable to said filtration system.

11. The apparatus of claim 10 wherein the apparatus is adjoinable to said filtration system by placement within the skimmer of the filtration system.

12. The apparatus described in claim 1 wherein said driving mechanism comprises an electric motor.

13. The apparatus described in claim 1 wherein said driving mechanism comprises an internal combustion engine.

14. The apparatus described in claim 1 wherein said driving mechanism comprises a turbine driven by water passing through the apparatus.

15. A method for maintaining a skimmer of a swimming pool filtration system comprising the steps of:

disposing at least one belt within said skimmer so as to be partially submerged in the water of a swimming pool; and circulating said at least one belt in such a manner as to lift debris from the water and deposit it outside the filtration system and outside the swimming pool.

16. The method described in claim 15 further comprising the step of collecting said debris in a receptacle.

17. The method of claim 15 comprising the following additional steps:

positioning the at least one belt between a top axis and a bottom axis, said top axis being disposed outside the filtration system and outside the swimming pool, said bottom axis being disposed underneath the water.

* * * * *